US008146383B2

(12) United States Patent
Lorek et al.

(10) Patent No.: US 8,146,383 B2
(45) Date of Patent: Apr. 3, 2012

(54) COOLING APPLIANCE

(75) Inventors: Manfred Lorek, Siegen (DE); Joachim Kinscher, Wilnsdorf (DE)

(73) Assignee: Dometic GmbH, Siegen (DE)

( * ) Notice: Subject to any disclaimer, the term of this patent is extended or adjusted under 35 U.S.C. 154(b) by 709 days.

(21) Appl. No.: 11/722,240

(22) PCT Filed: Oct. 26, 2005

(86) PCT No.: PCT/EP2005/011469

§ 371 (c)(1),
(2), (4) Date: Jun. 20, 2007

(87) PCT Pub. No.: WO2006/066650

PCT Pub. Date: Jun. 29, 2006

(65) Prior Publication Data

US 2010/0011800 A1 Jan. 21, 2010

(30) Foreign Application Priority Data

Dec. 21, 2004 (DE) ..... 20 2004 019 713 U

(51) Int. Cl.
*F25D 11/02* (2006.01)

(52) U.S. Cl. ..... 62/441; 62/443

(58) Field of Classification Search ..... 62/441, 62/252, 253, 443, 447, 519, 298, 259.1; 312/296, 312/404; 220/529, 544
See application file for complete search history.

(56) References Cited

U.S. PATENT DOCUMENTS 3,027,732 A 4/1962 Mann et al.
3,407,016 A * 10/1968 Kronenberger ..... 312/296
3,590,594 A * 7/1971 Arend ..... 62/117
4,217,010 A * 8/1980 Webb ..... 312/407
4,638,644 A * 1/1987 Gidseg ..... 62/329
4,732,435 A * 3/1988 Bailey et al. ..... 312/311
4,741,175 A * 5/1988 Schulze ..... 62/442
4,771,532 A * 9/1988 Taylor et al. ..... 29/455.1
4,876,860 A * 10/1989 Negishi ..... 62/179
4,914,341 A * 4/1990 Weaver et al. ..... 312/407
5,056,332 A * 10/1991 Tajima et al. ..... 62/252
5,285,652 A * 2/1994 Day ..... 62/199

(Continued)

FOREIGN PATENT DOCUMENTS

DE 685189 C 12/1939

(Continued)

OTHER PUBLICATIONS

International Search Report dated Mar. 2, 2006.

*Primary Examiner* — Mohammad Ali
(74) *Attorney, Agent, or Firm* — Pearne & Gordon LLP

(57) ABSTRACT

A cooling appliance 1 including a housing 2 and a cooling unit 3, 4 is adapted such that the interior of said cooling appliance 1 is separable into at least two cooling zones 6, 7 by inserting an insert member (5), wherein one of said cooling zones is built as separate freezer section 6 or froster, respectively. In a cooling appliance 1 including a housing 2 and cooling unit 3, 4 an insert member 5 separating said interior of said cooling appliance 1 into at least two cooling zones 6, 7, is arranged in the interior of said cooling appliance 1, wherein said insert member 6 is built as preassembled unit inserted into said cooling appliance 1 by means of guide members 8 arranged in said housing 2.

21 Claims, 3 Drawing Sheets

U.S. PATENT DOCUMENTS

| | | | | |
|---|---|---|---|---|
| 5,577,822 | A * | 11/1996 | Seon | 312/404 |
| 5,845,503 | A * | 12/1998 | Choi | 62/89 |
| 5,931,004 | A * | 8/1999 | Yoo et al. | 62/82 |
| 6,119,468 | A * | 9/2000 | Seok | 62/89 |
| 6,327,867 | B1 * | 12/2001 | Hyodo et al. | 62/187 |
| 6,370,895 | B1 * | 4/2002 | Sakuma et al. | 62/199 |
| 6,715,305 | B2 * | 4/2004 | Doi et al. | 62/180 |
| 6,880,903 | B2 * | 4/2005 | O'Halloran et al. | 312/407 |
| 7,032,408 | B2 * | 4/2006 | Dentella et al. | 62/441 |
| 7,036,895 | B2 * | 5/2006 | Han | 312/404 |
| 2002/0069654 | A1 * | 6/2002 | Doi et al. | 62/199 |
| 2003/0131618 | A1 * | 7/2003 | Doi et al. | 62/180 |
| 2004/0104654 | A1 * | 6/2004 | Lee et al. | 312/401 |
| 2004/0107727 | A1 * | 6/2004 | Kim et al. | 62/525 |

FOREIGN PATENT DOCUMENTS

| | | | |
|---|---|---|---|
| EP | 1152201 | A | 11/2001 |
| FR | 1485432 | A | 6/1967 |

* cited by examiner

COOLING APPLIANCE

The invention relates to a cooling appliance including a housing and a cooling unit. In the interior of the cooling appliance an insert member separating the interior of the cooling appliance into two cooling zones, can be located.

Traditional refrigerators comprises an insulated housing with a compartment particularly insulated for low temperatures and sealed by a flap or a door. Depending on their intended use, cooling appliances can in addition be equipped with a freezer section, i.e. appliances are offered with and without freezer section. As a rule, therefore, already when selecting a refrigerator for a given intended use a decision has to be taken whether a freezer section is to be integrated or not.

For given fields of use, e.g. in the equipment of leisure vehicles, the question as to necessity of a freezer section cannot be decided doubtlessly. Whether—at the cost of the space available—a freezer section is required, is determined by the individual desires of the consumer in particular.

Therefore, several options have to be taken into account when equipping leisure vehicles. In particular, equipment with uniform cooling appliances is not possible. In addition, as a rule the entire refrigerator has to be exchanged, when a consumer desires a cooling appliances with another equipment.

Starting on these facts, the object of the present invention lies in that a cooling appliance which in flexible manner and low expense can be equipped with or without freezer section or can be re-equipped correspondingly, is made available.

This object is solved by a cooling appliance in accordance with claim 1 or claim 4.

The cooling appliance as defined in claim 1 includes a housing and a cooling unit, said cooling appliance being adapted such that the interior of the cooling appliance is separable into at least two cooling zones by inserting an insert member.

By insertion of the insert member preferably a separate freezer section or a froster, resp., can be separated from a cooling area. The two cooling zones, thus, have different temperatures. In the area used as refrigerator, usually temperatures over 0° C. are prevailing, whereas area used as freezer section or froster, resp., the temperatures are below 0° C.

The invention is based on the idea that the cooling appliance without insert member already is to comprises as many as possible means permitting the deliver the interior of the cooling appliance—depending on the customer's desire—as refrigerator without freezer section or, however, to integrate a freezer section in particularly simple manner. Therein, the insert member is to be installed as low in costs and simple as possible. Moreover, the insert member preferably is not to include expensive technical components, as e.g. a cooling unit, a ventilator, a temperature control or terminals. The required technical components for the modification including a freezer section, e.g. corresponding cooling units generating different cooling temperatures in the individual cooling zones, are already to be integrated in the refrigerator. Additionally, e.g. the insulation of the refrigerator housing can in different wall section of the cooling appliance already be adapted to for which temperatures the adjacent interior is possibly intended for. The insulation will be improved in the wall sections of the possible freezer section in particular, as compared to the traditional insulation of refrigerator walls.

By the above-described appliance both modifications, with or without freezer section, can be realized. Subsequent equipment can be effected as favorable in costs and uncomplicated as does a change in equipment from the modification with freezer section to the modification without freezer section.

For a fitter of leisure vehicles e.g. and for the manufacturer of the cooling appliances the appliances in accordance with the present invention increase flexibility in production and in equipment, as in advance no decision has to be taken in which number refrigerators with and without freezer section will be used. Such decision can be taken as late as when buying a vehicle or equipping the leisure vehicle, respectively. However, the invention is not to be limited to refrigerators for leisure vehicles. Rather can the cooling appliance in accordance with the present invention be suitable for various kinds of use.

In particular, the housing includes guide member for pushing in and/or fitting the insert member in the housing interior.

The insert member preferably is formed as pre-assembled unit for pushing it into the interior of the refrigerator.

The cooling appliance as defined in claim 4 includes a housing and a cooling unit, wherein in the interior of the cooling appliance an insert member separating the interior into at least two cooling zones, is arranged. The insert member is build as pre-assembled unit which is inserted into the cooling appliance by means of guide members arranged in the housing.

The insert member as entity can be pushed into or pulled out, respectively, from the interior of the cooling appliance with the aid of the guide members. Beside a simplification of assembly, in this manner also errors during assembly can be avoided. Assembly or change in assembly can in case of doubt even be carried out by the consumer himself. The insert member can be delivered together with the refrigerator to give the consumer a cost-saving option for equipment with a freezer section. Thus, high flexibility is achieved in the decision whether a freezer section is to be integrated or whether the entire interior of the cooling appliance is to be used as refrigerator.

In particular, the guide members are formed on the inside wall of the housing.

The guide members can include depressions and/or guide grooves in the side walls and/or the rear wall of the housing of the cooling appliance.

Alternatively or supplementarily, the guide members can also include shoulders on the inside housing wall. E.g., strips for accommodating the insert member thereon or guide rails can be provided for. The insert member can correspondingly be formed as push member. E.g., the insert member can be formed in shape of a pull-out drawer or as pull-out box, maybe with a locking possibility.

The guide members in addition can include a means for fixation and/or locking of the pushed-in insert member in its assembled position. Thus, not only safe hold of the insert member is guaranteed but its desired position is defined in addition. In this way, incorrect positionings and inaccuracies during assembly and output loss connected thereto can be avoided.

The means for fixation and/or locking of the pushed-in insert member can comprise recesses and/or a latch in the guide members for fixation and/or locking of the insert member in the guide members. E.g., a recess in a guide rail can be provided for mesh with a latch arranged on the insert member, or vice versa. Within the frame of the invention all possibilities common for an expert for fixation of the insert member are to be included.

The insert member in particular includes at least one bottom part and one flap connected to said bottom part.

The bottom part can be arranged as intermediate wall between two cooling zones.

On the outer rim of the bottom part a sealing can be arranged, together with the housing walls sealing the cooling zones against one another in case of inserted insert member. It can be pointed to the rim of the bottom part, e.g. in 2-C injection molding method (two-component injection molding method), and be made form a softer synthetic material than the material used for the bottom part.

The flap of the insert member can be pivotally connected to the bottom part of closing the freezer section or the froster, respectively.

The housing of the cooling appliance is formed insulated against heat transmission or heat passage, respectively, wherein the insulation in different wall sections is adapted to the cooling zones provided for in the interior. Thus, the walls of the freezer area can have a better insulation than the walls which only border the cooling area. If e.g. the freezer zone is provided for in the upper area of the housing, the top area and the side walls in this area of the housing are insulated particularly well. The cooling area located therebelow is limited by walls with sufficient but cheaper insulation.

The cooling appliance is built such that it can produce different temperatures in the cooling zones.

Further features and advantages of the invention result from the following description of an embodiment. Therein:

Figure 1:
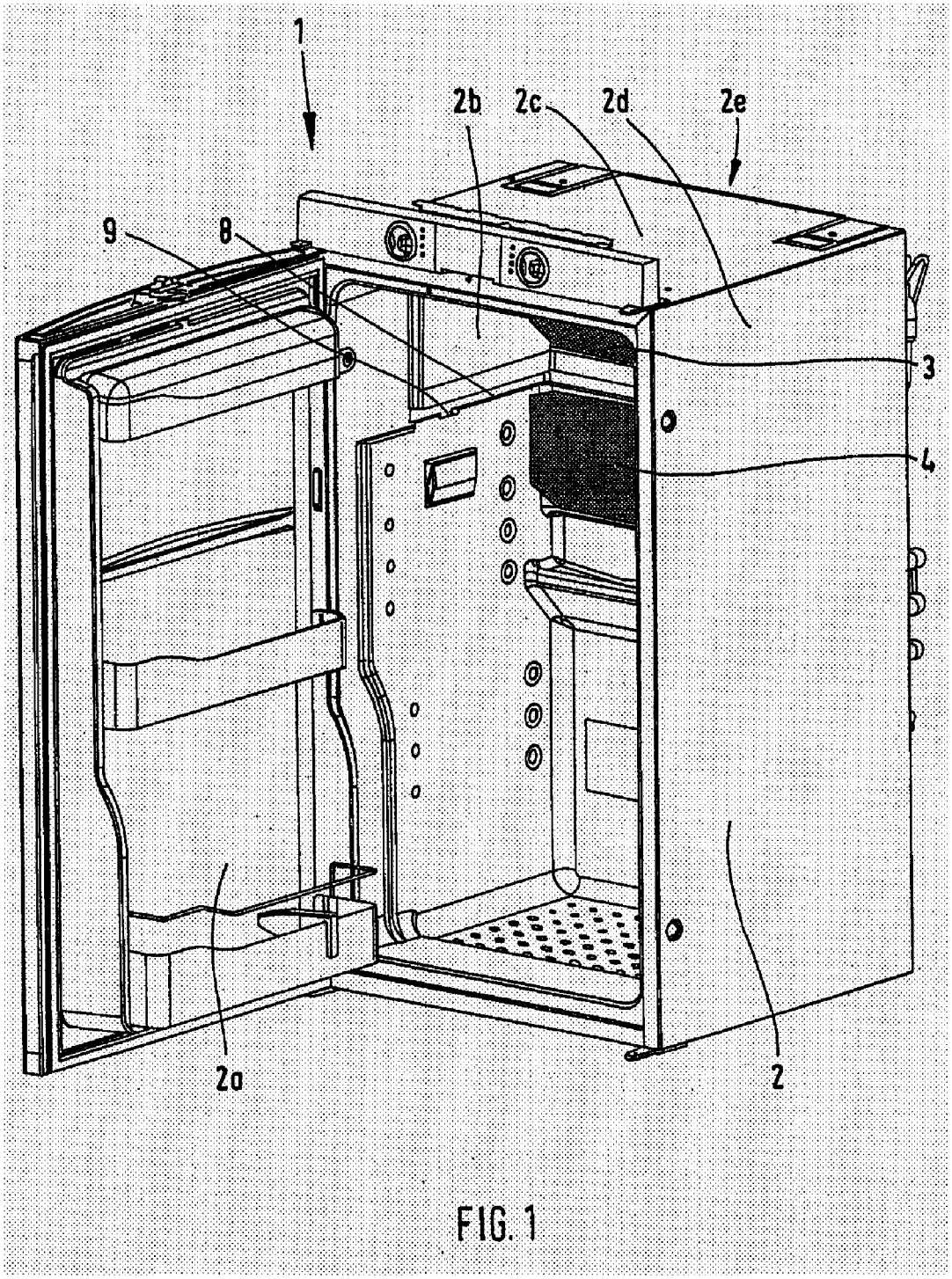
FIG. 1 shows a cooling appliance in accordance with the present invention in its basic equipment.

FIG. 1 shows a cooling appliance 1 with a housing 2 and a cooling unit. The invention is suitable for all kinds of cooling appliances used. E.g. the cooling appliance in accordance with the present invention can be an absorption refrigerator, a compression refrigerator etc.

Said housing 2 comprises the refrigerator door 2*a* as well as wall sections with different degrees of heat insulation. In particular, the upper sections of the side walls 2*b*, 2*d*, the upper section 2*e* of the backside wall as well as the cover 2*c* of said housing 2 have a better insulation than the remaining wall sections or said housing 2.

Said cooling unit is essentially arranged on the backside of said housing. Elements 3 and 4 of said cooling unit, e.g. evaporator units, absorb heat from the interior of said refrigerator 1.

Said cooling unit can be provided with one temperature regulation or one temperature regulation, respectively, for each of said elements 3 and 4. In addition, said cooling unit can be equipped with the usual, known means, e.g. with illumination means, LEDs in particular, warning means displaying malfunctioning of said cooling appliance or individual cooling zones, respectively.

On the inside of the lateral housing walls a horizontal recess 8 is provided for as guide for an insert member for separating a freezer zone from the remaining cooling chamber. Into said recess 8 an intermediate wall can be pushed from the front side. Said recess 8 in the embodiment also extends along the inside of said rear wall of said housing 2. In the area of said lateral guide members 8 a further vertical recess 9 serving for locking and fixation of a pushed-in insert member, e.g. with the aid of a corresponding latch arranged on said insert member, is provided for.

In the example shown in FIG. 1, however, no insert member is inserted, so that in this case the entire interior of said cooling appliance 1 can be used a refrigerator with essentially uniform inside temperature. Thus, a spacious cooling chamber results, whereas—if required—subsequent equipment with a freezer section is possible.

Figure 2:
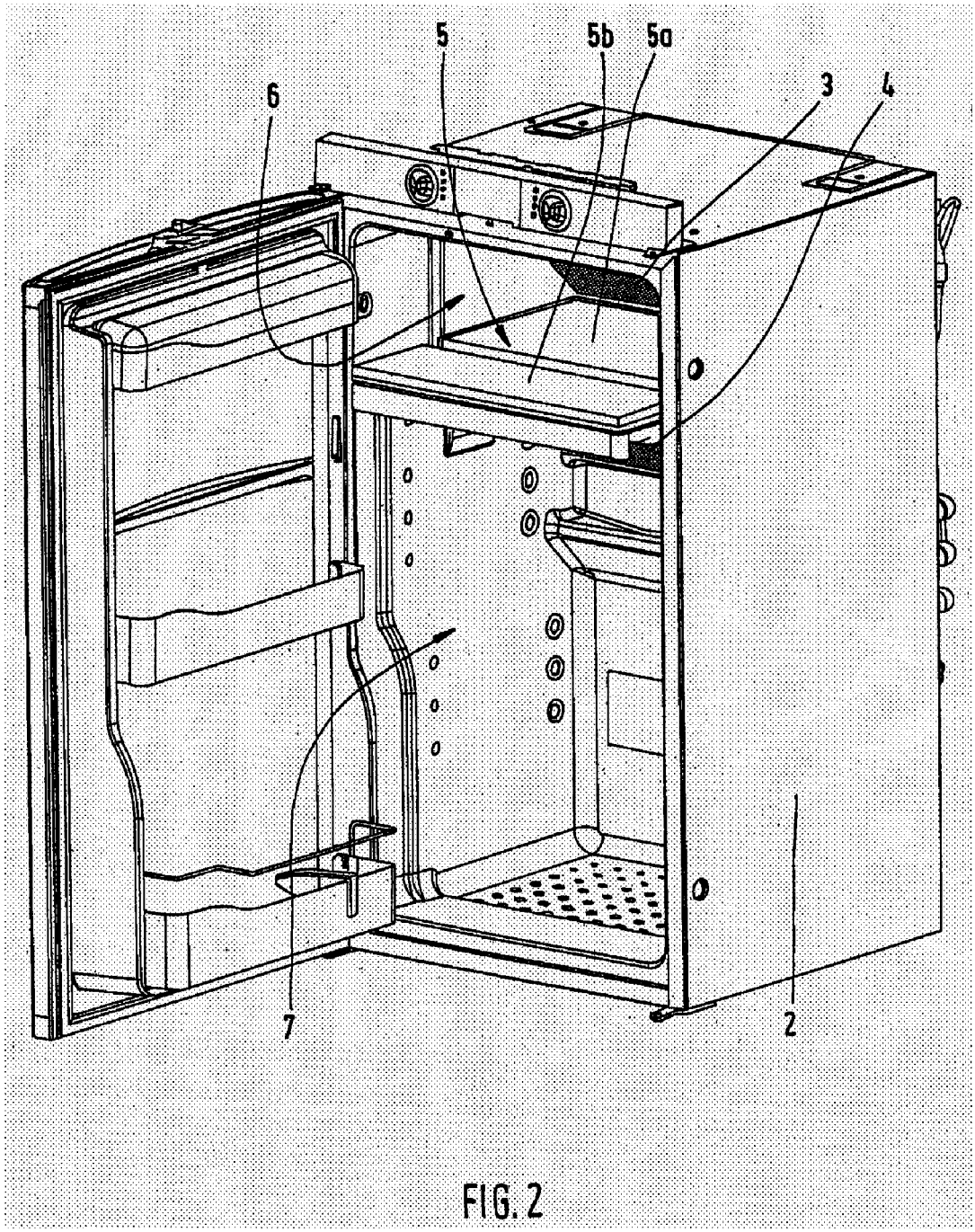
FIG. 2 shows the cooling appliance from FIG. 1 with inserted opened freezer section.

In FIG. 2 said cooling appliance from FIG. 1 is shown with an insert member 1 inserted into said housing 2 of said cooling appliance 1. Said insert member 5 therein forms an integral preassembled member which includes at least a bottom part 5*a* and a flap door 5*b*. The lateral edges as well as the rearward edge of said bottom part 5*a* are build and adapted thus that they engage with said recesses 8 when said part 5 is pushed into said interior of said housing 2. In particular, said bottom part 5*a* can comprise a locking mechanism, a latch e.g. When reaching the assembled position said latch arranged on the bottom side of said bottom part 5*a* interlocks with said vertical recess 9 for fixing said insert member 5 in its desired position.

Said insert member 5 can in total be of comparatively simple construction so that the difference in costs for a cooling appliance with or without freezing option is low. No expensive technical means in particular (e.g. ventilator, temperature control) or terminals need to be provided on said insert member 5. If possible all technical presuppositions for the integration of a freezer section are already to be realized in the basic version of said cooling appliance under FIG. 1. Said insert member 5 can therefore be inserted easily and if applicable be included into the delivery of any cooling appliance as supplementary member.

On the edges engaging with said recesses 8, of said bottom part 5*a* of said insert member 5 preferably a sealing 5*c* e.g. out of a elastomere is arranged. Said sealing 5*c* can be molded to said edges of said bottom part 5*a* by 2-C-injection molding method. It permits safe separation and insulation of said freezer zone 6 from said cooling zone 7.

Said flap door 5*b* of said insert member 6 is pivotally connected to said bottom part 5*a*.

By insertion of said insert member 5 two cooling zones 6 and 7 which can be cooled to different temperatures by members 3 and 4 of said cooling unit, are created. Thus, in the present embodiment the upper delimited area 6 is used a freezer section with temperatures below 0° C. e.g., whereas the lower delimited area 7 meets the function of a refrigerator with temperatures above 0° C. The respective temperature of an area 6, 7 can e.g. be achieved by different cooling outputs generated by said members 3 and 4. In addition, it is conceivable to provided for two separate cooling units.

Figure 3:
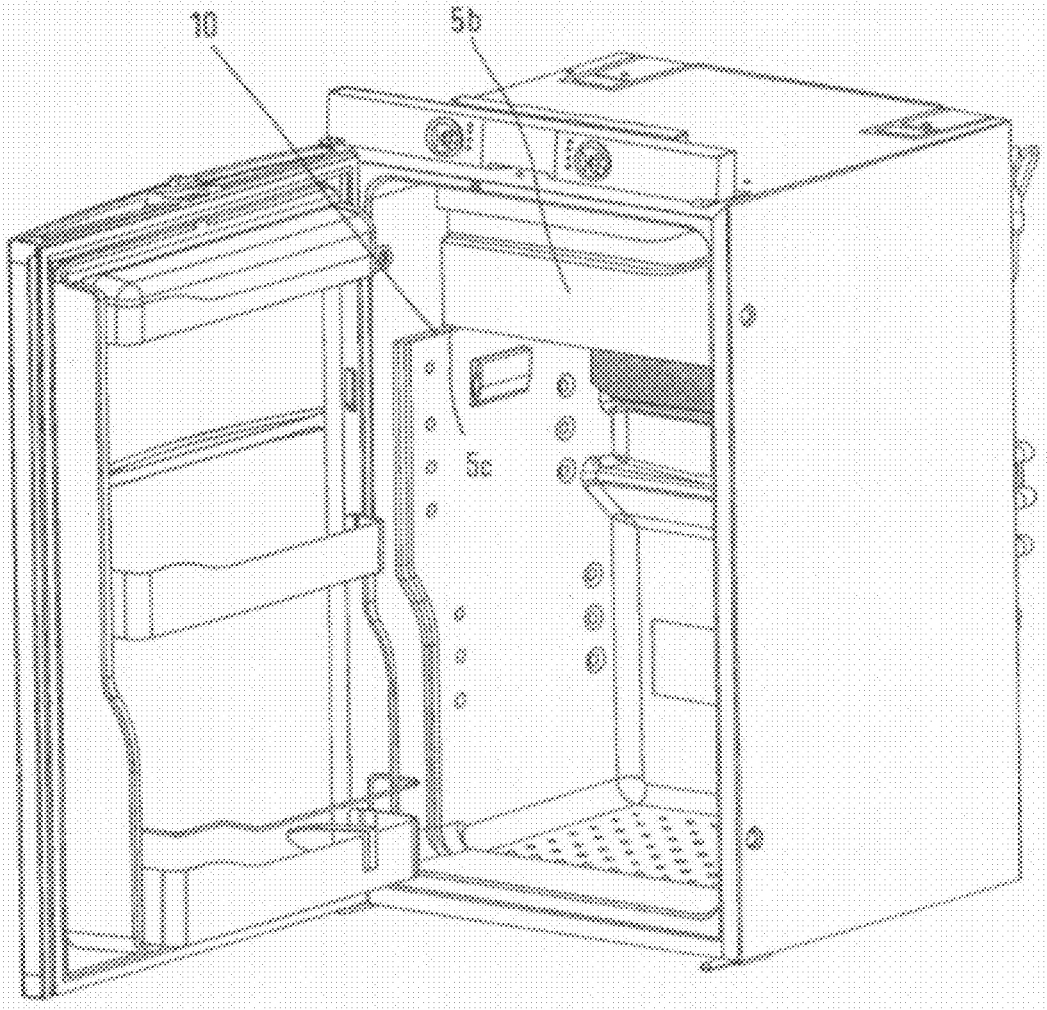
FIG. 3 shows the cooling appliance from FIG. 1 with closed freezer section.

Said flap door 5*b* in the present embodiment can be hinged from top to bottom for opening said freezer section. As becomes evident in connection with FIG. 3, said flap door 5*b* in case of opened freezer section 6 can rest on a horizontal shoulder 10 formed in said side wall and thus allow comfortable access to said freezer section 6. In closed condition said flap door 5*a* insulates said freezer section 6 with respect to said cooling chamber 7.

Using said shown cooling appliance 1 it is possible depending on the consumer's desire in simple manner to extend a leisure vehicle with refrigerator by a freezer section 6. Change or supplementation in equipment of said cooling appliance 1 can be done in simple and cost-saving manner. The decision whether a cooling appliance 1 is to be equipped with a freezer section 6 can be passed in dependence on the individual conception of the consumer by short action.

The invention claimed is:

1. An absorption refrigerator including a housing and a cooling unit, whereby the interior of said absorption refrigerator is separable by insertion of an insert member into at least two cooling zones, characterized in that the absorption refrigerator comprises at least a further cooling unit, whereby each of the at least of two cooling zones has at least one cooling unit, wherein one of said cooling zones is formed as separate freezer section or a froster, respectively, and wherein the insert member is removable from the interior.

2. The absorption refrigerator as defined in claim 1, characterized in that said housing comprises guide members for pushing in and/or fitting in said insert member into said housing interior.

3. The absorption refrigerator as defined in claim 1, characterized in that said insert member is built as preassembled unit for push-in into the interior of said absorption refrigerator.

4. The absorption refrigerator as defined in claim 2, characterized in that said guide members are formed on said inside wall of said housing.

5. The absorption refrigerator as defined in claim 2, characterized in that said guide members include a recess and/or a guide groove in said side walls and/or in said rear wall of said housing.

6. The absorption refrigerator as defined in claim 2, characterized in that said guide members include a shoulder formed on said housing inside wall.

7. The absorption refrigerator as defined in claim 1, characterized in that said absorption refrigerator includes a means for fixing and/or locking said insert member in its assembled position.

8. The absorption refrigerator as defined in claim 7, characterized in that said means for fixing and/or locking includes a recess and/or a latch in said guide members for fixation and/or locking said insert member.

9. The absorption refrigerator as defined in claim 1, characterized in that said insert member comprises a bottom part and a flap connected to said bottom part.

10. The absorption refrigerator as defined in claim 9, characterized in that said bottom part is arranged as intermediate wall between two cooling zones.

11. The absorption refrigerator as defined in claim 9, characterized in that between said bottom part and said walls of said housing a sealing which is molded in particular to edge sections of said bottom part, is arranged.

12. The absorption refrigerator as defined in claim 9, characterized in that said flap for sealing said freezer section or froster, respectively, is pivotally connected to said bottom part.

13. The absorption refrigerator as defined in claim 1, characterized in that said housing is built insulated against heat transfer, wherein said insulation in different wall areas of said housing is adapted to said cooling zones provided for in the interior of said absorption refrigerator.

14. The absorption refrigerator as defined in claim 1, characterized in that said cooling unit can generate different temperatures in said cooling zones.

15. The absorption refrigerator as defined in claim 12, characterized in that said flap in closed condition insulates said freezer section or froster from the other of said cooling zones.

16. The absorption refrigerator as defined in claim 13, characterized in that the walls areas of said housing surrounding the freezer section provides a higher degree of insulation than remaining wall areas of said housing.

17. The absorption refrigerator defined in claim 1, characterized in that said cooling unit includes a first evaporator and said further cooling unit includes a second evaporator.

18. The absorption refrigerator defined in claim 1, characterized in that an element of said cooling unit and an element of said further cooling unit absorb heat from the interior of said absorption refrigerator.

19. An absorption refrigerator including a housing and a cooling unit, wherein in the interior of said absorption refrigerator an insert member separating said interior of said absorption refrigerator into at least two cooling zones is arranged and built as preassembled unit which is inserted into said absorption refrigerator by means of guide members arranged in said housing, characterized in that the absorption refrigerator comprises at least a further cooling unit, whereby each of the at least two cooling zones has at least one cooling unit, and the insert member is removable from the interior.

20. The absorption refrigerator defined in claim 19, characterized in that said cooling unit includes a first evaporator and said further cooling unit includes a second evaporator.

21. An absorption refrigerator including a housing and a cooling unit, whereby the interior of said absorption refrigerator is separable by insertion of an insert member into at least two cooling zones, characterized in that the absorption refrigerator comprises at least a further cooling unit, whereby each of the at least of two cooling zones has at least one cooling unit, wherein one of said cooling zones is formed as separate freezer section or a froster, respectively, and wherein the insert member is removable from the interior, said housing comprises guide members for pushing in and/or fitting said insert member into said housing interior, said guide members include a horizontal recess and a vertical recess in side walls of said housing, said insert member comprises a bottom part and a flap connected to said bottom part, said horizontal recess is configured to support said bottom part, said vertical recess is configured to fix and/or lock said insert member in its assembled position, said flap is pivotally connected to said bottom part, and said flap in closed condition insulates said freezer section or froster from the other of said cooling zones.

* * * * *